US010161658B2

(12) United States Patent
Russo et al.

(10) Patent No.: US 10,161,658 B2
(45) Date of Patent: Dec. 25, 2018

(54) MODULAR COIL FOR AIR COOLED CHILLERS

(71) Applicant: Carrier Corporation, Farmington, CT (US)

(72) Inventors: Jackie S. Russo, Canastota, NY (US); Lee G. Tetu, Baldwinsville, NY (US)

(73) Assignee: CARRIER CORPORATION, Farmington, CT (US)

( * ) Notice: Subject to any disclaimer, the term of this patent is extended or adjusted under 35 U.S.C. 154(b) by 242 days.

(21) Appl. No.: 14/776,237

(22) PCT Filed: Feb. 27, 2014

(86) PCT No.: PCT/US2014/018832
§ 371 (c)(1),
(2) Date: Sep. 14, 2015

(87) PCT Pub. No.: WO2014/149482
PCT Pub. Date: Sep. 25, 2014

(65) Prior Publication Data

US 2016/0033180 A1 Feb. 4, 2016

Related U.S. Application Data

(60) Provisional application No. 61/788,516, filed on Mar. 15, 2013.

(51) Int. Cl.
*F24F 1/06* (2011.01)
*F25B 39/00* (2006.01)
(Continued)

(52) U.S. Cl.
CPC ..... *F25B 39/00* (2013.01); *F24F 1/06* (2013.01); *F24F 1/68* (2013.01); *F24F 2221/36* (2013.01); *F25B 39/04* (2013.01)

(58) Field of Classification Search
CPC ... F25B 39/00; F25B 39/04; F24F 1/06; F24F 1/68; F24F 2221/36
(Continued)

(56) References Cited

U.S. PATENT DOCUMENTS 3,305,006 A * 2/1967 Daltry ..... F28B 1/06 165/110
3,472,042 A * 10/1969 Shriver ..... F28D 5/02 165/121
(Continued)

FOREIGN PATENT DOCUMENTS

CN 101652611 A 2/2010
CN 202329275 U 7/2012
(Continued)

OTHER PUBLICATIONS

Notification Transmittal of the International Search Report and the Written Opinion of the International Searching Authority, or the Declaration for International Application No. PCT/US2014/018832 dated Jun. 23, 2014; dated Jul. 1, 2014; 9 pages.
(Continued)

*Primary Examiner* — Justin M Jonaitis
(74) *Attorney, Agent, or Firm* — Cantor Colburn LLP

(57) ABSTRACT

A condenser module configured for use in a condenser is provided including a housing having a first longitudinal side that defines a first air inlet and an opposing second longitudinal side that defines a second air inlet. A heat exchanger assembly is positioned within the housing. The heat exchanger assembly includes at least one heat exchanger coil. A cross-section of the heat exchanger assembly is generally constant between a front side of the housing and an opposite back side of the housing. At least one of the front surface and the back surface is configured to abut an adjacent contact module. A fan assembly includes at least
(Continued)

one fan generally aligned with a single heat exchanger coil in the heat exchanger assembly.

9 Claims, 6 Drawing Sheets

(51) Int. Cl.
*F24F 1/68* (2011.01)
*F25B 39/04* (2006.01)

(58) Field of Classification Search
USPC ..... 165/121
See application file for complete search history.

(56) References Cited

U.S. PATENT DOCUMENTS 3,857,253 A * 12/1974 Burgett ..... F25B 1/053 62/289
3,878,273 A 4/1975 Anderson
3,917,764 A 11/1975 Phelps
3,943,728 A * 3/1976 Maudlin ..... F25B 39/04 165/127
4,367,183 A * 1/1983 Carbonaro ..... F28C 1/14 165/60
4,788,013 A 11/1988 Kinney, Jr. et al.
5,181,395 A * 1/1993 Carpenter ..... F25B 39/04 165/110
5,279,360 A * 1/1994 Hughes ..... F25B 39/02 165/111
5,435,382 A 7/1995 Carter
7,281,387 B2 * 10/2007 Daddis, Jr. ..... A47F 3/0408 165/110
7,600,743 B2 * 10/2009 Dorin ..... F28B 1/06 165/60
2008/0083237 A1 * 4/2008 Street ..... F25B 49/027 62/196.4
2008/0141525 A1 * 6/2008 Breiding ..... B23K 1/0012 29/726.5
2010/0199714 A1 * 8/2010 Yanik ..... F25B 39/04 62/507
2011/0120171 A1 * 5/2011 Cho ..... F28B 1/06 62/428
2013/0333410 A1 * 12/2013 Cho ..... F24F 1/06 62/426

FOREIGN PATENT DOCUMENTS

| | | | |
|---|---|---|---|
| CN | 102753895 | A | 10/2012 |
| EP | 0748998 | A2 | 12/1996 |
| FR | 1249717 | A | 12/1960 |
| FR | 2628189 | | 9/1989 |
| GB | 1050792 | | 12/1966 |
| JP | 2003279074 | A | 10/2003 |
| JP | 2009243754 | A | 10/2009 |
| WO | 2008124637 | A2 | 10/2006 |
| WO | 2011099629 | A1 | 8/2011 |

OTHER PUBLICATIONS

CN Office Action with Translation; Application No. 201480027649.0; dated Jul. 12, 2017; pp. 1-21.
PCT International Preliminary Report on Patentability; IPRP; International Application No. PCT/US2014/018832; International Filing Date: Feb. 27, 2014; dated Sep. 15, 2015; pp. 1-6.
Second Office Action and Search Report for Chinese Patent Application No. 201480027649, dated Mar. 28, 2018 (7 pp.).

* cited by examiner

MODULAR COIL FOR AIR COOLED CHILLERS

BACKGROUND OF THE INVENTION

The invention relates generally to air conditioning systems and, more particularly, to a modular condenser coil arrangement for a condenser of an air conditioning system.

In a conventional air conditioning system, the condenser of the refrigeration circuit is located exterior to a building. Typically, the condenser includes a condensing coil, a fan for circulating a cooling medium over the condensing coil. The air conditioning system further includes an indoor unit having an evaporator for transferring heat energy to the indoor air to be conditioned.

Air cooled condensers including air cooled chillers and rooftops, are often used for applications requiring large capacity cooling and heating. Because larger condenser coil surfaces are needed for the functionality of the system, the condenser generally includes a plurality of condensers units. Each of these condenser units includes a heat exchanger coil arranged generally laterally within a condenser housing such that the units may be stacked to accommodate a maximum micro-channel heat exchanger length. Multiple fans are located on top of the condenser housing for each unit.

For instance, in lateral V-shaped coil arrangements, air enters through either side of the condenser housing, makes an abrupt 90 degree turn, passes through one of the legs of the V, turns again, and exits in an upward direction. This results in an uneven air distribution and variable face velocity across the condenser coil. Further non-uniformities and inefficiencies can be caused during single fan operation. The lateral V-shaped coil arrangement does not allow for one fan/one coil operation and fan to fan short circuiting can become a problem. The conventional condenser arrangements suffer from other inherent issues as well including issues related to water drainage and heat pump applications.

BRIEF DESCRIPTION OF THE INVENTION

According to an aspect of the invention, a condenser module configured for use in a condenser is provided including a housing having a first longitudinal side that defines a first air inlet and an opposing second longitudinal side that defines a second air inlet. A heat exchanger assembly is positioned within the housing. The heat exchanger assembly includes at least one heat exchanger coil. A cross-section of the heat exchanger assembly is generally contact between a front side of the housing and an opposite back side of the housing. A fan assembly includes at least one fan generally aligned with a single heat exchanger coil in the heat exchanger assembly.

According to yet another aspect of the invention, a condenser is provided including a plurality of condenser modules and a frame configured to receive the plurality of condenser modules. Each condenser module includes a housing having a first longitudinal side that defines a first air inlet and an opposing second longitudinal side that defines a second air inlet. A heat exchanger assembly is positioned within the housing. The heat exchanger assembly includes at least one heat exchanger coil. A cross-section of the heat exchanger assembly is generally constant between a front side of the housing and an opposite, back side of the housing. A fan assembly includes at least one fan generally aligned with a single heat exchanger coil in the heat exchanger assembly. The plurality of condenser modules are stacked within the frame such that at least one of the front surface and the back surface of each condenser module is arranged adjacent to either the front surface or the back surface of another condenser module.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
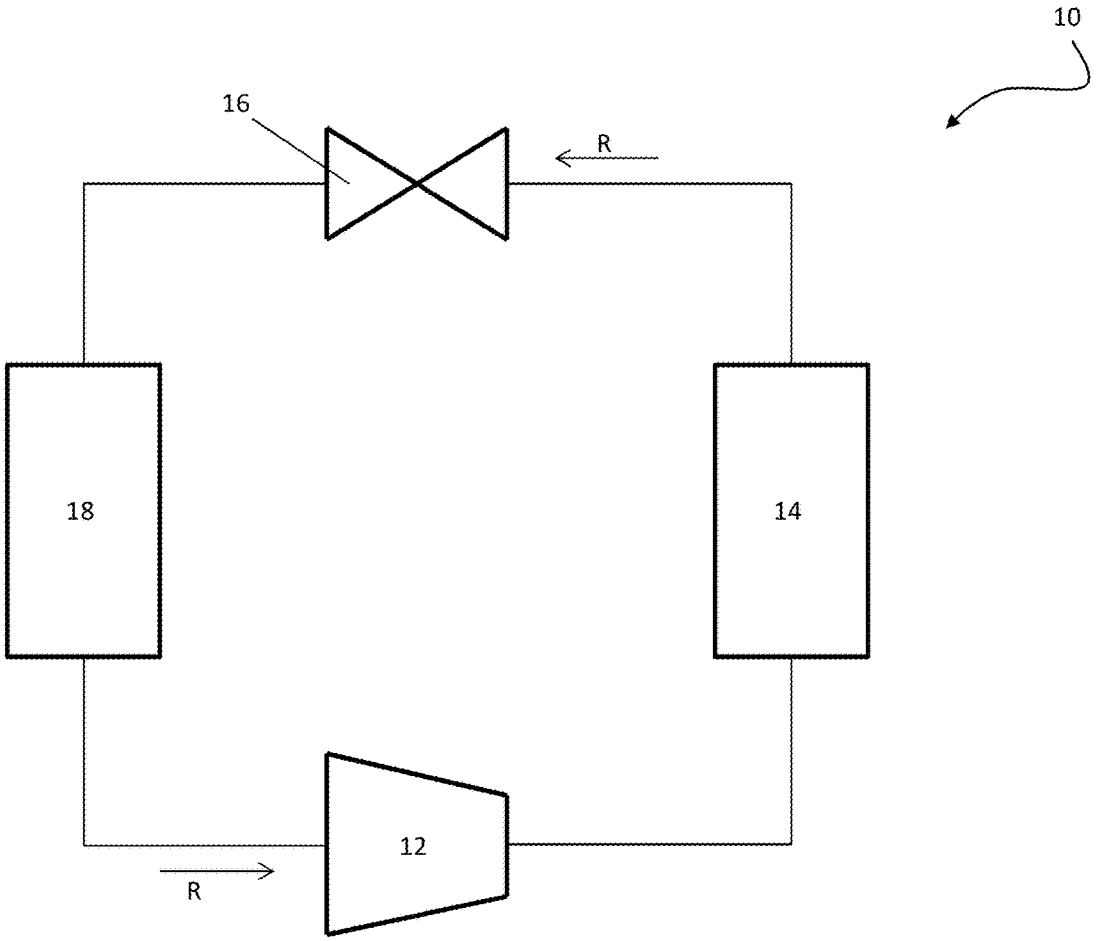
FIG. 1 is a schematic diagram of a vapor-compression cycle of an air conditioning system.

Referring now to FIG. 1, a conventional vapor compression or refrigeration cycle 10 of an air conditioning system is schematically illustrated. Exemplary air conditioning systems include split, packaged, and rooftop systems, for example. A refrigerant R is configured to circulate through the vapor compression cycle 10 such that the refrigerant R absorbs heat when evaporated at a low temperature and pressure and releases heat when condensing at a higher temperature and pressure. Within this cycle 10, the refrigerant R flows in a counterclockwise direction as indicated by the arrows. The compressor 12 receives refrigerant vapor from the evaporator 18 and compresses it to a higher temperature and pressure, with the relatively hot vapor then passing to the condenser 14 where it is cooled and condensed to a liquid state by a heat exchange relationship with a cooling medium such as air or water. The liquid refrigerant R then passes from the condenser 14 to an expansion valve 16, wherein the refrigerant R is expanded to a low temperature two phase liquid/vapor state as it passes to the evaporator 18. The low pressure vapor then returns to the compressor 12 where the cycle is repeated.

Figure 2:
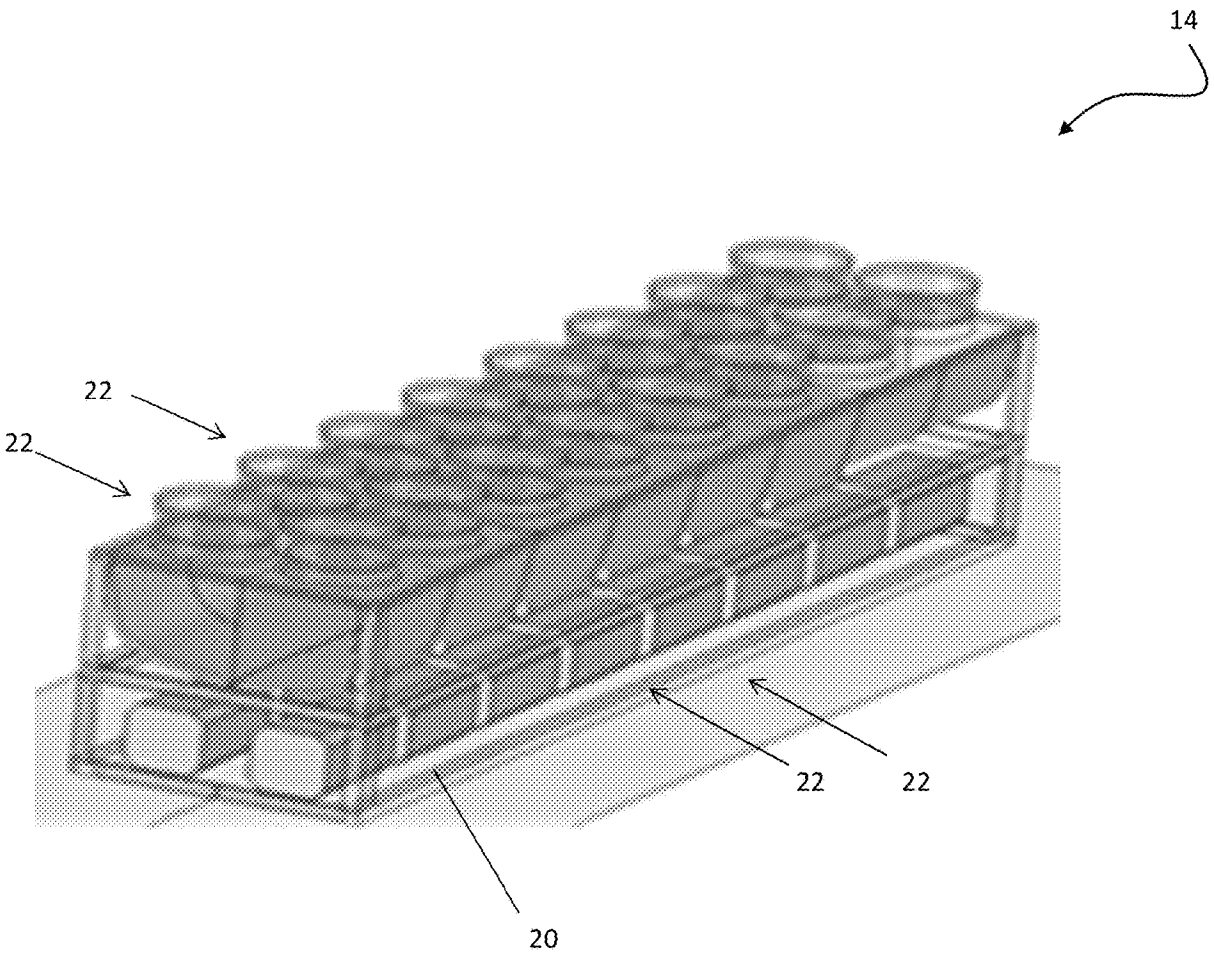
FIG. 2 is a perspective view of a condenser according to an embodiment of the invention.
Figure 3:
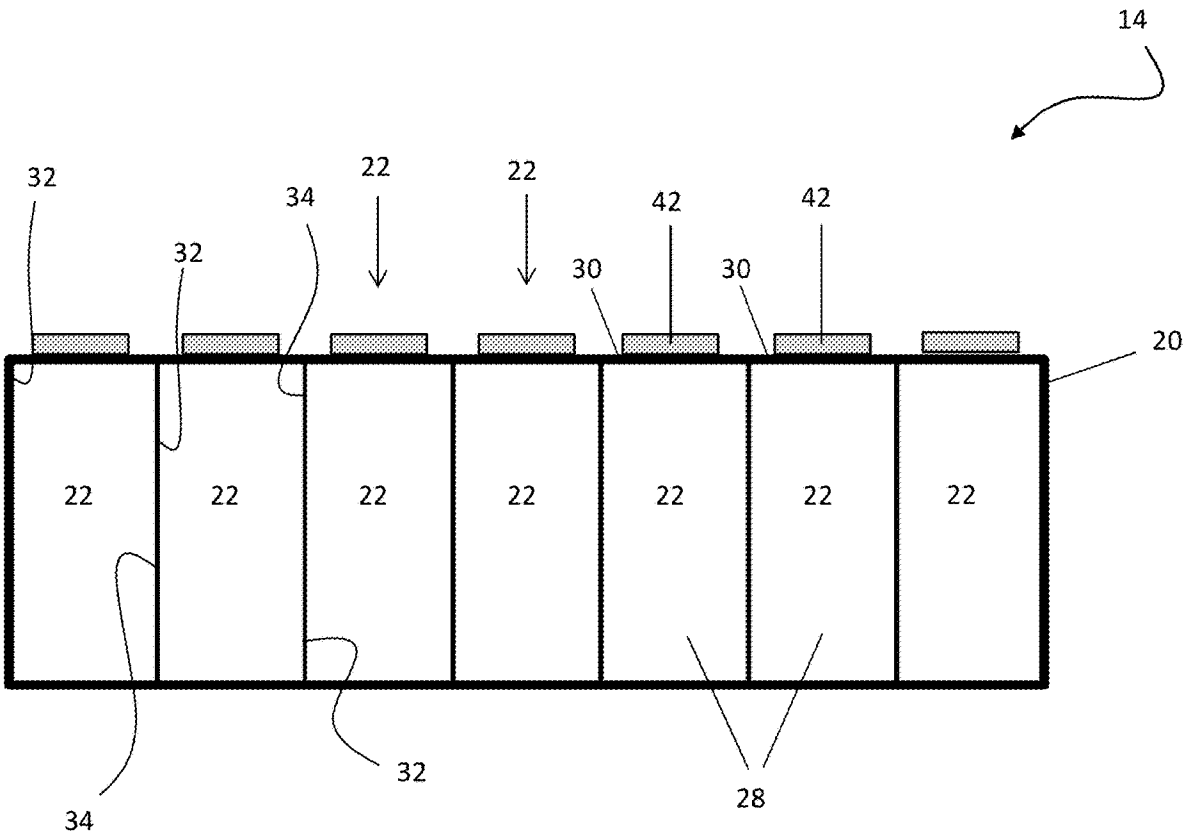
FIG. 3 is side view of a condenser according to an embodiment of the invention.
Figure 4:
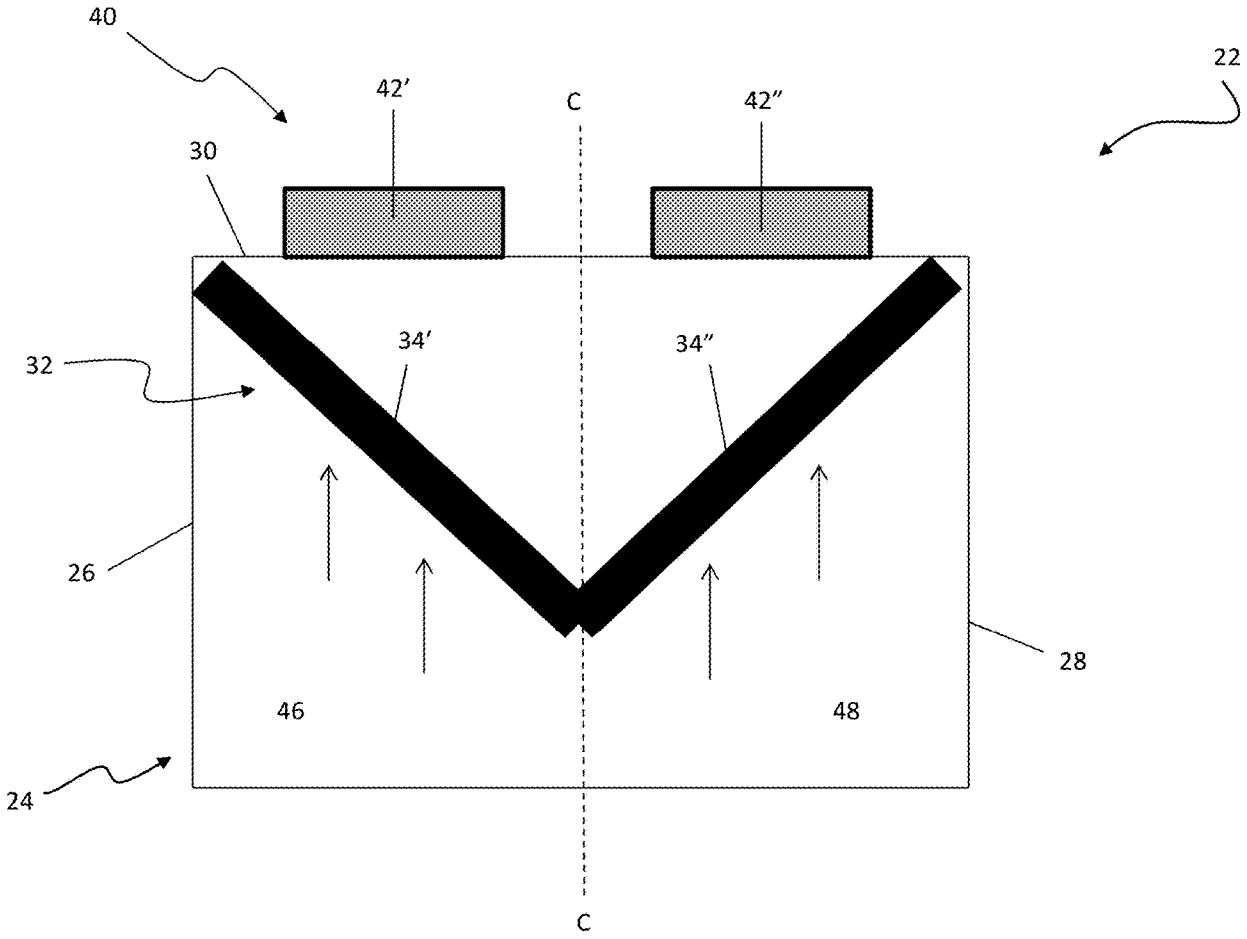
FIG. 4 is a front view of a condenser module according to an embodiment of the invention.
Figure 4A:
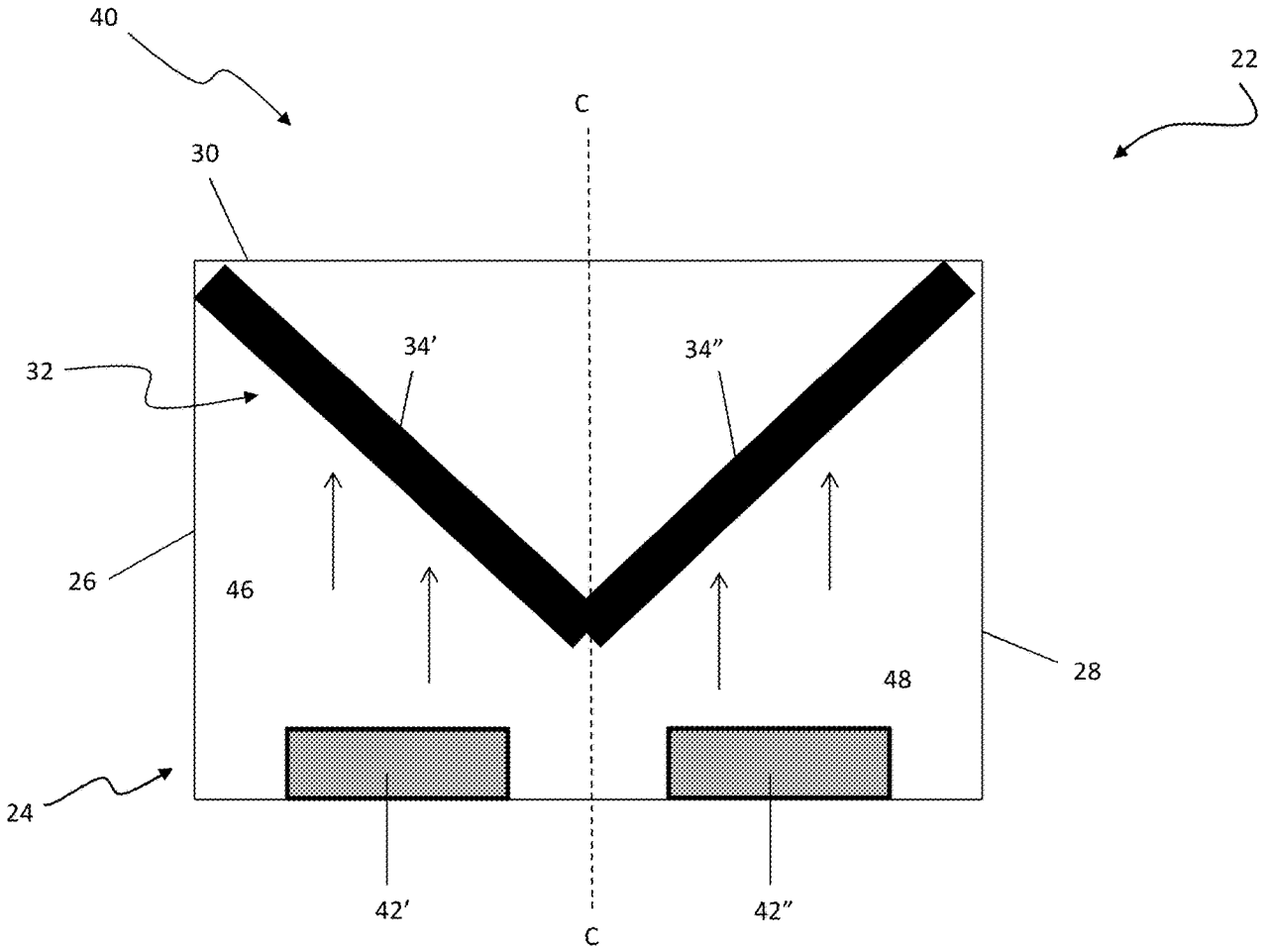
FIG. 4A is a front view of a condenser module according to another embodiment of the invention.
Figure 5:
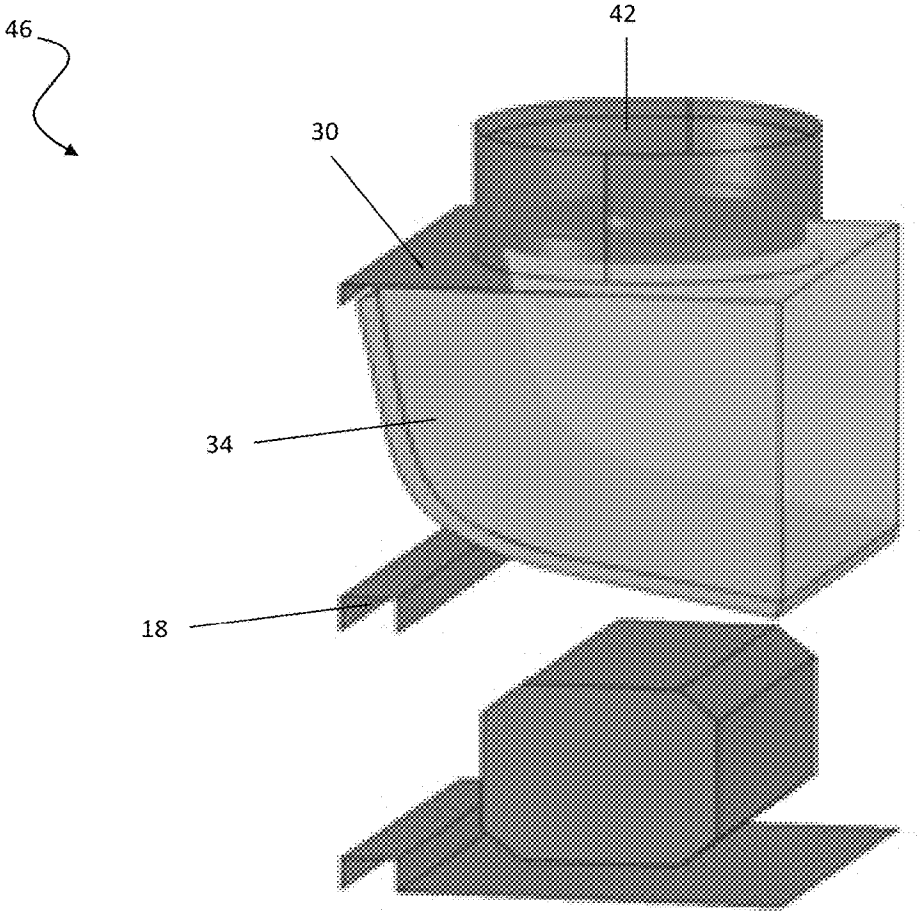
FIG. 5 is a portion of a condenser module according to an embodiment of the invention.

Referring now to FIGS. 2 and 3, an air-cooled condenser 14, such as used in the vapor compression cycle 10 of FIG. 1, is illustrated in more detail. The condenser 14 includes one or more identical condenser modules 22 positioned within a frame 20, such as the type of frame 20 normally found on building rooftops for example. Any number of condenser modules 22 may be installed within the frame 20 to form a condenser 14 configured to meet the capacity and cooling requirements for a given application. Referring now to the exemplary condenser module 22 illustrated in FIG. 4, the condenser module 22 includes a housing or cabinet 24 configured to be received within the frame 20. Opposing longitudinal sides 26, 28 of the housing 24 each define an inlet for air to flow into the module 22. Similarly, a first end 30 of the housing 24, connected to both of the opposing longitudinal sides 26, 28, defines an outlet opening for air to exit from the condenser module 22. In one embodiment, when the condenser modules 22 are positioned within the frame 20 at least one of an opposing front surface 32 and back surface 34 of the housing 24 is arranged adjacent to either a front surface 32 or a back surface 34 of the housing 24 of another condenser module 22 (see FIG. 3) such that the plurality of condenser modules 22 are stacked generally longitudinally within the frame 20.

Located within the housing 24 of each condenser module 22 is a heat exchanger assembly 32 arranged between the opposing longitudinal sides 26, 28. The cross-section of the heat exchanger assembly 32 is generally constant over a length of the condenser module 22, such as between the front surface 32 and the back surface 34 for example. The heat exchanger assembly 32 includes at least one heat exchanger coil 34, for example a micro-channel heat exchanger coil, through which the refrigerant R flows. The plurality of heat exchanger coils 34 of the heat exchanger assembly 32 may, but need not be, arranged generally symmetrically or equidistantly spaced from a center of the condenser module 22 between the opposing longitudinal sides 26, 28, as illustrated schematically by line C. In the illustrated, non-limiting embodiment, the heat exchanger assembly 32 includes a first heat exchanger coil 34' mounted to the first longitudinal side 26 of the housing 24 and a second, heat exchanger coil 34" mounted to the second longitudinal side 28 of the housing 24. The first heat exchanger coil 34' and the second heat exchanger coil 34" may, but need not be, substantially identical. The plurality of heat exchanger coils 34 may be arranged within the housing 24 such that the heat exchanger assembly 32 has a generally V-shaped configuration, as is known in the art. Alternative configurations of the heat exchanger assembly 32, such as the generally U-shaped configuration illustrated in FIG. 2, an A-shaped configuration, or a generally horizontal configuration for example, are also within the scope of the invention. In one embodiment, the heat exchanger assembly 32 may include a multiple bank, flattened tube, finned heat exchanger having multiple tube banks arranged generally downstream from one another relative to an air flow.

The condenser module 22 additionally includes a fan assembly 40 configured to circulate air through the housing 24 and the heat exchanger assembly 32. The air flowing through the condenser module 22 may discharge to a air duct (not shown), or alternatively, may draw in air directly from an outside source through a duct type section, i.e. sound absorbing panels for example. Depending on the characteristics of the condenser module 22, the fan assembly 40 may be positioned either downstream with respect to the heat exchanger assembly 32 (i.e. "draw through configuration") as shown in the FIGS., or upstream with respect to the heat exchanger assembly 32 (i.e. "blow through configuration").

In one embodiment, the fan assembly 40 is mounted at the first end 30 of the housing 24 in a draw-through configuration. The fan assembly 40 generally includes at least one fan 42 configured to draw air through each of the respective heat exchanger coils 34 in the heat exchanger assembly 32. In one embodiment, the plurality of fans 42 in the fan assembly 40 substantially equals the plurality of heat exchanger coils 34 in the heat exchanger assembly 32. In addition, the at least one fan 42 configured to draw air through a respective heat exchanger coil 34 is generally vertically aligned with that coil 34. For example, in embodiments where the heat exchanger assembly 32 includes a first heat exchanger coil 34' and second heat exchanger coil 34", at least a first fan 42' is generally aligned with the first heat exchanger coil 34' and at least a second fan 42" is generally aligned with the second heat exchanger coil 34".

In one embodiment, a divider (not shown), such as formed from a piece of sheet metal for example, extends inwardly from the first end 30 of the housing 24 along the center line C. The divider may be used to separate the condenser module 22 including the heat exchanger assembly 32 and the fan assembly 40 into a plurality of generally identical modular portions, such as a first portion 46 and a second portion 48 for example.

Operation of the at least one fan 42 associated with the at least one heat exchanger coil 34 in either the first or second modular portion 46, 48 of the condenser module 22 causes air to flow through an adjacent air inlet and into the housing 24. As the air passes over the heat exchanger coil 34, heat transfers from the refrigerant R inside the coil 34 to the air, causing the temperature of the air to increase.

By arranging the heat exchanger assembly 32 generally longitudinally between the opposing longitudinal sides 26, 28 of the housing 24, the number of turns in the flow path of air entering the housing 24 is reduced to a single turn. This new orientation of the heat exchanger assembly 32 also allows for better run off which reduces the likelihood of corrosion and allows for evaporative condensing. In addition, inclusion of generally modular portions 46, 48 within each condenser module 22 provides up to a significant reduction in the system losses in the module 22 as well as in the required fan power. Because the velocity of the air through the housing 24 is more uniform, the heat transfer capability of the condenser module 22 is improved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A condenser comprising:

a frame;

a plurality of condenser modules stacked within the frame, the plurality of condenser modules including a first condenser module and a second condenser module, each condenser module including:

a housing having a front side, a back side, a first longitudinal side and an opposite, second longitudinal side, each of the first longitudinal side and the second longitudinal side defining an air inlet;

a heat exchanger assembly contained within the housing, the heat exchanger assembly including a first heat exchanger coil having a major surface facing the first longitudinal side and a second heat exchanger coil having a major surface facing the second longitudinal side, wherein a cross-section of the heat exchanger assembly is constant between the front side and the back side of the housing;

a fan assembly including a first fan aligned with the first heat exchanger coil and a second fan aligned with the second heat exchanger coil; and wherein the plurality of condenser modules are stacked longitudinally within the frame such that the back side of the first condenser module is positioned directly adjacent the front side of the second condenser module the first longitudinal side of the first condenser module is arranged directly adjacent the first longitudinal side of the second condenser module, and the first heat exchanger coils of the first condenser module and the second condenser module are horizontally aligned adjacent the first longitudinal side over a length of the frame, and the second heat exchanger coils of the first condenser module and the second condenser module are horizontally aligned adjacent the second longitudinal side over a length of the frame.

2. The condenser according to claim 1, wherein the plurality of condenser modules are identical.

3. The condenser according to claim 1, wherein at least one of the first heat exchanger coil and the second heat exchanger coil is a micro-channel heat exchanger coil.

4. The condenser according to claim 1, wherein the first heat exchanger coil is mounted to the first longitudinal sidewall and the second heat exchanger coil is mounted to the second longitudinal sidewall.

5. The condenser module according to claim 1, wherein the fan assembly is mounted to the housing in a blow-through configuration.

6. The condenser according to claim 1, wherein the fan assembly is mounted to a top surface of the housing in a draw through configuration.

7. The condenser according to claim 1, wherein a divider extends along a center line between the first longitudinal side and the second longitudinal side to create a first modular portion and a second modular portion.

8. The condenser according to claim 7, wherein the first modular portion and the second modular portion are identical.

9. The condenser according to claim 1, wherein the heat exchanger assembly includes one of a V-shaped configuration, an A-shaped configuration, a U-shaped configuration, and a horizontal configuration.

* * * * *